US006322417B1

(12) United States Patent
Bass

(10) Patent No.: US 6,322,417 B1
(45) Date of Patent: Nov. 27, 2001

(54) AIR-DRIVEN HOPPING TOY

(75) Inventor: Sid Bass, Los Angeles, CA (US)

(73) Assignee: Mattel Inc., El Segundo ( * ) Notice: Subject to any disclaimer, the term of this patent is extended or adjusted under 35 U.S.C. 154(b) by 0 days.

(21) Appl. No.: 09/498,107

(22) Filed: Feb. 4, 2000

(51) Int. Cl.[7] ..... A63H 13/00; A63H 11/06

(52) U.S. Cl. ..... 446/198; 446/311

(58) Field of Search ..... 446/180, 193, 446/197, 198, 177, 308, 309, 311, 312, 429, 486

(56) References Cited

U.S. PATENT DOCUMENTS

| | | | | |
|---|---|---|---|---|
| 437,209 | * | 9/1890 | Lancaster | 446/190 |
| 536,512 | * | 3/1895 | Crossley et al. | 446/198 |
| 1,859,268 | * | 5/1932 | Larson | 446/190 |
| 2,425,429 | * | 8/1947 | Hansen | 446/311 |
| 2,570,584 | | 10/1951 | Miskin et al. . | |
| 2,776,525 | * | 1/1957 | Ford | 446/199 |
| 3,089,279 | * | 5/1963 | Higgins, Jr. | 446/198 |
| 3,417,507 | | 12/1968 | Ryan et al. . | |
| 3,997,157 | * | 12/1976 | Meyer | 446/197 |
| 4,216,610 | | 8/1980 | Ferris . | |
| 4,388,776 | | 6/1983 | Spring . | |
| 4,411,249 | | 10/1983 | Fogarty et al. . | |
| 4,669,997 | | 6/1987 | Kulesza et al. . | |
| 4,689,033 | | 8/1987 | Droller et al. . | |
| 4,889,513 | | 12/1989 | Paddock . | |
| 4,897,065 | | 1/1990 | Fertig et al. . | |
| 5,381,778 | | 1/1995 | D'Andrade et al. . | |
| 5,415,153 | | 5/1995 | Johnson et al. . | |
| 5,538,453 | | 7/1996 | Johnson . | |
| 5,941,755 | * | 8/1999 | Danielian | 446/312 |

* cited by examiner

*Primary Examiner*—D. Neal Muir
(74) *Attorney, Agent, or Firm*—Roy A. Ekstrand

(57) ABSTRACT

A toy includes a supporting frame having a pair of legs secured to a pair of feet by pivotal attachments. The frame further supports a cockpit within which a removable toy figure is seated. The toy frame further supports an air cylinder which is angled rearwardly and downwardly with respect to the remainder of the frame. A piston having a piston rod is movably supported within the cylinder and defines an outer end which is pivotally secured to a third foot. The pressure end of the air cylinder is coupled by an air tube to a collapsible bellows. Squeezing of the air bellows produces compressed air within the cylinder causing extension thereof which drives the toy upwardly and forwardly from the support surface by the extension of the third foot.

5 Claims, 2 Drawing Sheets

AIR-DRIVEN HOPPING TOY

FIELD OF THE INVENTION

This invention relates generally to toy figures having an action feature and particularly to those which exhibit a leaping or jumping function.

BACKGROUND OF THE INVENTION

Through the years, a variety of toys have been produced which employ some sort of figure having the capacity to leap or jump. Various types of apparatus have been utilized to cause the upward motion necessary for leaping to occur. These devices have included spring-loaded apparatus as well as air-driven apparatus or the like. In addition, various types of projectile launcher devices have been created which employ pneumatic systems of various types.

Not surprisingly, such toy figures have been provided in forms which often resemble or mimic animal creatures. For example, U.S. Pat. No. 2,570,584 issued to Miskin, et al. sets forth a LEAPING FIGURE TOY having a frog-like figure supporting a pair of articulated rear legs. A pneumatic piston and rod expander are coupled to the rear legs and are energized by a squeeze bulb to cause the frog to leap.

U.S. Pat. No. 3,417,507 issued to Ryan, et al. sets forth a PROJECTILE FIRING TOY having a plurality of launching devices operated in response to a corresponding plurality of air-driven bellows. A plurality of track-like segments formed by hollow tubes interconnect the launchers.

U.S. Pat. No. 4,216,610 issued to Ferris sets forth a POP-UP TOY having a cylindrical toy supported upon a base and coupled to an extender mechanism. The extender mechanism includes a piston movable within a cylinder. The cylinder is coupled to a deformable air bulb by a hollow tube. Each time the bulb is squeezed or stepped on, the figure expands upwardly due to the cooperation of the cylinder and the piston.

U.S. Pat. No. 4,388,776 issued to Spring sets forth a PNEUMATICALLY OPERATED TOY EMPLOYING A MOVABLE IMPLEMENT having a master cylinder coupled to a slave cylinder by a hollow tube. The master cylinder is coupled to a piston moving apparatus having a rotating member and an eccentric coupling. The slave cylinder is coupled to an implement such as a saw. As a result, movement of the piston within the master cylinder causes a corresponding movement of the implement driven by the slave cylinder.

U.S. Pat. No. 4,411,249 issued to Fogarty, et al. sets forth a TOY GLIDER WITH PNEUMATIC LAUNCHER having a ring supported on the user's finger which further supports a hollow launch tube and a squeezeable air bulb in communication. A glider toy is receivable upon the launch tube and is launched from the ring when the user squeezes the bulb.

U.S. Pat. No. 4,669,997 issued to Kulesza, et al. sets forth PNEUMATIC ACTION TOY CREATURES each having a body with a hollow resilient compressible portion. An opening in the compressible portion receives an elongated piston with a cross-section substantially conforming to the opening to provide for pneumatic reciprocation of the piston.

U.S. Pat. No. 4,689,033 issued to Droller, et al. sets forth a FIGURE TOY WITH RAPIDLY EXTENSIBLE TONGUE which darts from the mouth of the figure when a pneumatic bulb formed within the toy is squeezed.

U.S. Pat. No. 4,889,513 issued to Paddock sets forth a TOY RACECAR LAUNCHER having a toy ramp upon which a toy vehicle is received. The ramp is pivotally movable and is driven at one end by an expandable air bellows. The bellows is expanded in response to movement of a foot pressed actuator.

U.S. Pat. No. 4,897,065 issued to Fertig, et al. sets forth a TOY VEHICLE AND HANDHELD PNEUMATIC LAUNCHER having a primary tube within which a hand movable piston is supported. A secondary tube is coupled to the primary tube and supported thereby. A glider toy is received upon the launch tube and is launched as the user moves the piston forwardly in the primary tube.

U.S. Pat. No. 5,188,557 issued to Brown sets forth a TOY ROCKET APPARATUS having a base supporting an upwardly extending launch tube coupled to a source of compressed air. A toy rocket is fitted upon the launch tube and is driven upwardly therefrom as the compressed air is released into the launched tube.

U.S. Pat. No. 5,381,778 issued to D'Andrade, et al., U.S. Pat. No. 5,415,153 issued to Johnson, et al. and U.S. Pat. No. 5,538,453 issued to Johnson each set forth various similar devices for launching a toy rocket using compressed air.

While the foregoing described prior art devices have to some extent improved the art and in some instances enjoyed commercial success, there remains nonetheless a continuing need in the art for evermore improved air-driven moving toys.

SUMMARY OF THE INVENTION

Accordingly, it is a general object of the present invention to provide an improved air-driven hopping toy. It is a more particular object of the present invention to provide an improved air-driven hopping toy which utilizes a novel launch mechanism and which supports a removable toy figure.

In accordance with the present invention, there is provided an air-driven hopping toy comprising: a frame; a pair of rigid legs extending downwardly from the frame, each of the legs having a foot; an air cylinder joined to the frame and extending downwardly and rearwardly between the legs; a piston movable within the cylinder having a downwardly extending piston rod; a third foot joined to the piston rod; and an air tube coupled to the air cylinder and collapsible air bellows coupled to the air tube, the bellows being squeezed to drive air into the air cylinder forcing the piston and piston rod downwardly and launching the toy forwardly and upwardly.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
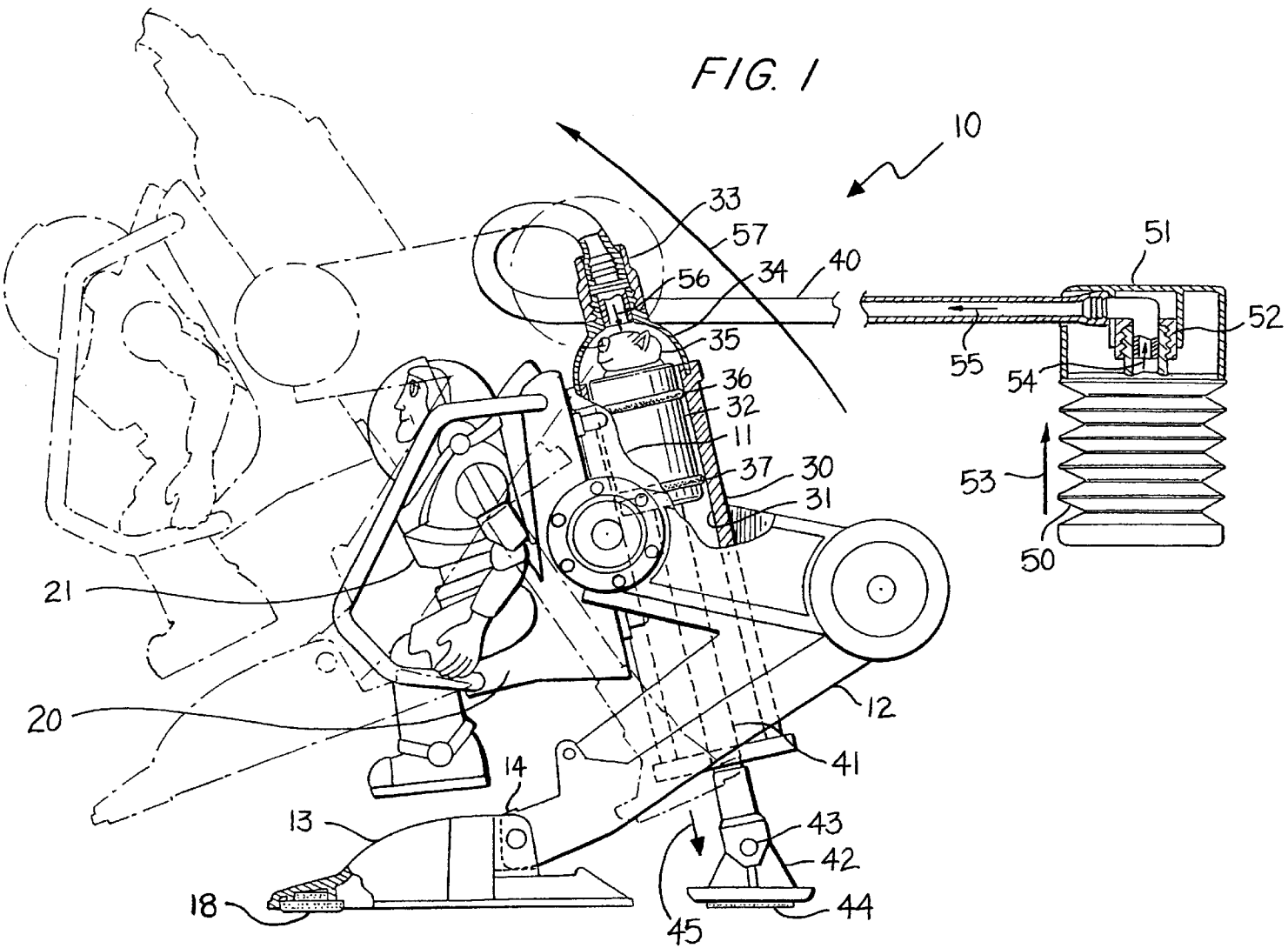
FIG. 1 sets forth a partially sectioned side view of an air-driven hopping toy constructed in accordance with the present invention.

FIG. 1 sets forth a partial section side elevation view of an air-driven hopping toy constructed in accordance with the present invention and generally referenced by numeral 10.

Figure 2:
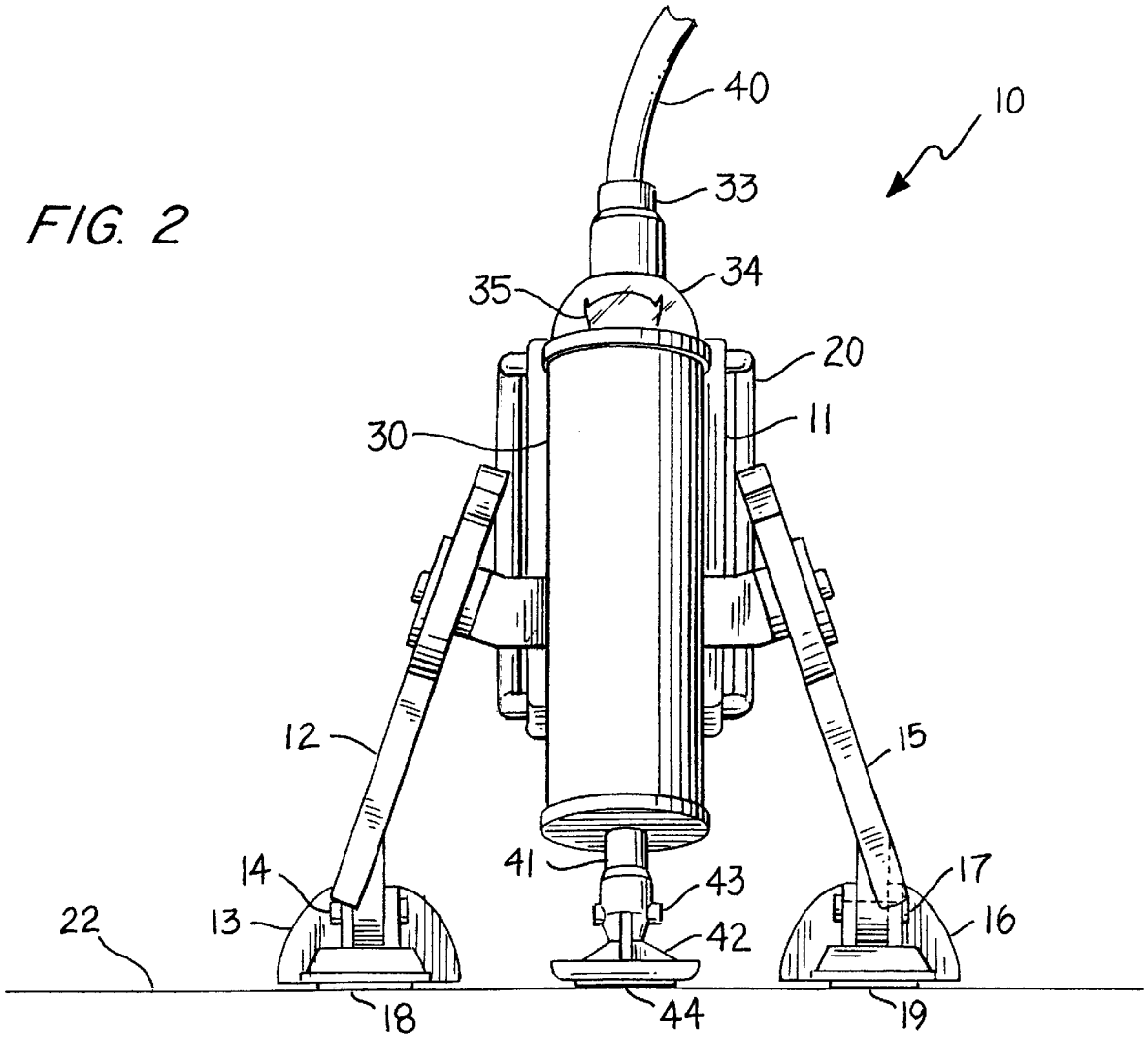
FIG. 2 sets forth a rear perspective view of the present invention air-driven hopping toy.

Air-driven toy 10 includes a frame 11 supporting a pair of legs 12 and 15 (leg 15 seen in FIG. 2). Leg 12 supports a foot 13 having a friction pad 18 on the undersurface thereof at a pivotal attachment 14. Similarly and as is better seen in FIG. 2, leg includes a foot 16 having a friction pad 19 on the undersurface thereof supported by a pivot 17.

Returning to FIG. 1, toy 10 further includes a cockpit 20 supported upon frame 11 which further supports a removable toy FIG. 21. Toy FIG. 21 is simply seated within cockpit 20 and is removable for standard play activity.

Frame 11 further supports a downwardly extending and rearwardly angled cylinder 30 having a cylinder bore 31 formed therein. The upper end of cylinder bore 31 is coupled to a transparent dome 34 which in turn supports a nozzle 33. A piston 32 having a pair of resilient seals 36 and 37 is slidably movable within bore 31 of cylinder 30. An elongated piston rod 41 is joined to piston 32 and extends downwardly from cylinder 30. Piston rod 41 is coupled to a foot 42 having a friction pad 44 on the undersurface thereof. A pivot 45 joins piston rod 41 to foot 42.

Toy 10 further includes a collapsible resilient air bellows 50 constructed in accordance with conventional fabrication techniques. Bellows 50 is secured to a head 51 which in turn supports a fitting 52. Fitting 52 is in communication with bellows 50. An air tube 40 preferably formed of a flexible hollow plastic material is coupled between nozzle 33 and fitting 52.

In operation, toy 10 rests upon a play surface such as play surface 22 shown in FIG. 2 supported by seat 13 and 16 (seen in FIG. 2) together with foot 42. When the user energizes toy 10 by rapidly collapsing bellows 50 in the direction indicated by arrow 53, pressurized air is driven outwardly through fitting 52 in the direction of arrow 54 which flows through tube 40 in the direction indicated by arrow 55 and eventually is forced into dome 34 in the direction indicated by arrow 56. Piston 52 which supports a toy FIG. 35 for added amusement is driven downwardly within bore 31 by the pressure against the upper side of piston 32. Thus, as piston 32 is driven downwardly, piston rod 41 is correspondingly extended downwardly in the direction indicated by arrow 45. The rapid extension of piston rod 41 with respect to cylinder 30 forces foot 42 downwardly against the underlying surface driving toy 10 upwardly. The angled position of cylinder 30 and its relative position within the remainder of toy 10 is chosen to provide an upward and forwardly directed launch of toy 10 as indicated by arrow 57. Thereafter, once the energy of cylinder 30 is expended, the user releases bellows 50 and piston rod 41 together with piston 32 is drawn upwardly within cylinder bore 31 and foot 42 is positioned for landing as the toy returns to the play surface.

FIG. 2 sets forth a rear perspective of toy 10 having air bellows 50 omitted. Upon a surface 22, toy 10 rests upon feet 13, 16 and 42 using friction pads 18, 19 and 44 respectively. As described above, toy 10 includes a frame 11 supporting a cockpit 20 and an air cylinder 30. Cylinder 30 includes an air dome 34 coupled to air tube 40 by a nozzle 33. A toy FIG. 35 is supported within cylinder 30 upon piston 32 in the manner seen in FIG. 1. Leg 15 is coupled to foot 16 by a pivot 17 while leg 12 is similarly coupled to foot 13 by a pivot 14. Piston rod 41 extends downwardly from cylinder 30 and is coupled to foot 42 by a pivot 43.

What has been shown is an novel air-driven hopping toy which supports a removable toy figure in a simulated cockpit and which is operated by a novel downwardly and rearwardly angled air-driven piston which is operative upon a third foot to launch the toy.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An air-driven hopping toy comprising:

a frame;

a pair of rigid legs extending downwardly from said frame, each of said legs having a foot;

an air cylinder joined to said frame and extending downwardly and rearwardly between said legs;

a piston movable within said cylinder having a downwardly extending piston rod;

a third foot joined to said piston rod; and an air tube coupled to said air cylinder and collapsible air bellows coupled to said air tube, said bellows being squeezed to drive air into said air cylinder forcing said piston and piston rod downwardly and launching said toy forwardly and upwardly.

2. The toy set forth in claim 1 wherein said frame includes a cockpit and wherein said toy includes a toy figure receivable in said cockpit.

3. The toy set forth in claim 2 wherein said third foot includes an undersurface and a friction pad thereon.

4. The toy set forth in claim 3 wherein said third foot is pivotally attached to said piston rod.

5. The toy set forth in claim 4 wherein said pair of feet are pivotally attached to said pair of legs.

* * * * *